United States Patent [19]

Majkrzak

[11] 4,391,235

[45] Jul. 5, 1983

[54] VEHICLE EXHAUST GAS WARM-UP HEATER SYSTEM

[76] Inventor: David S. Majkrzak, 345 Cherry Ct., West Fargo, N. Dak. 58078

[21] Appl. No.: 267,797

[22] Filed: May 28, 1981

[51] Int. Cl.[3] ..... F02N 17/02

[52] U.S. Cl. ..... 123/142.5 R

[58] Field of Search ..... 123/142.5

[56] References Cited

U.S. PATENT DOCUMENTS

| | | | |
|---|---|---|---|
| 1,101,751 | 6/1914 | Mason | 123/142.5 |
| 1,168,623 | 1/1916 | Furber . | |
| 1,260,796 | 3/1918 | Peters | 123/142.5 |
| 1,925,032 | 8/1933 | Dunner | 257/241 |
| 2,405,145 | 8/1946 | Holthouse | 123/142.5 |
| 2,677,359 | 5/1954 | Fielder | 123/142.5 |
| 2,858,823 | 11/1958 | Kelley | 123/142.5 |
| 2,894,265 | 7/1959 | Reardon | 4/147 |
| 3,201,934 | 8/1965 | Smith | 60/31 |
| 3,406,903 | 10/1968 | Kidder | 236/102 |
| 3,417,920 | 12/1968 | Tyson | 237/12.3 |
| 3,752,222 | 8/1973 | Olbermann, Jr. | 165/35 |
| 3,886,919 | 6/1975 | Freeman | 123/133 |
| 4,095,575 | 6/1978 | Wulf | 123/142.5 R |
| 4,258,676 | 3/1981 | Lamm | 123/142.5 |

FOREIGN PATENT DOCUMENTS

| | | | |
|---|---|---|---|
| 1087473 | 10/1980 | Canada | 123/142.5 |
| 2363686 | 6/1975 | Fed. Rep. of Germany | 123/142.5 |
| 361971 | 2/1973 | U.S.S.R. | 123/142.5 |

*Primary Examiner*—Wendell E. Burns

*Attorney, Agent, or Firm*—Kinney, Lange, Braddock, Westman and Fairbairn

[57] ABSTRACT

Liquid coolant of a liquid cooling system of an engine in a motor vehicle is heated by using hot exhaust gas emitted by the engine. A heat exchanger transfers heat from the hot exhaust gas to the coolant. A portion of the coolant is transferred from the engine cooling system to the heat exchanger and then back to the engine. A diverter valve actuated by a temperature sensing device diverts the exhaust gas from an exhaust system to the heat exchanger. The temperature sensing device actuates the diverter valve at a predetermined coolant temperature diverting the exhaust gas to the heat exchanger when the coolant is cold and shuts off the flow of the exhaust gas to the heat exchanger when the coolant is sufficiently warm.

11 Claims, 3 Drawing Figures

VEHICLE EXHAUST GAS WARM-UP HEATER SYSTEM

BACKGROUND OF THE INVENTION

1. Field of the Invention

The present invention relates to a system which preheats liquid coolant of an engine cooling system, and in particular, it relates to a system which heats the liquid coolant by using the exhaust gas emitted by the engine.

2. Description of the Prior Art

Internal combustion engines operate inefficiently when they are cold. Inefficient engine operation is a severe problem, especially with regard to fuel wastage during the winter in colder climates. In the prior art, many systems and devices have been developed to use the exhaust system of an internal combustion engine to prewarm some engine system, such as the fuel system, or the cooling system, and help bring the engine to an efficient operating temperature more quickly.

Devices and systems to warm the fuel of an internal combustion engine using the exhaust gas are described in the following U.S. Pat. Nos.: Dunner 1,925,032, Holthouse 2,405,145, Smith 3,201,934, Freeman 3,866,919. Heating the fuel aids fuel vaporization which increases engine efficiency, but does not necessarily help in raising the temperature of the engine to an efficient operating temperature more quickly.

Other prior art systems which warm the coolant of the cooling system by using the exhaust gases are described in the following U.S. Pat. Nos.: Mason 1,101,751, Peters 1,260,796, Kelley 2,858,823, Fielder 2,677,359. The Mason and Peters patents show apparatus which would not be desirable in today's motor vehicles. The Kelley patent includes an auxiliary internal combustion engine for heating the coolant of a main engine by using the exhaust gas of the auxiliary engine. The system of the Kelley patent would not be practical on most motor vehicles. The system of the Fielder patent involves using exhaust gas from a combustion type booster heater to heat the coolant, again an impractical idea on most of today's motor vehicles.

Other prior art patents describe systems which use the exhaust gases to heat the coolant of the same internal combustion engine. These U.S. Pat. Nos. are: Furber 1,168,623, Tyson 3,417,920, Wulf 4,095,575. In particular, the above prior art patents show the coolant being automatically diverted by a thermostatically controlled valve to some type of heat exchanger from which heat is transferred from the exhaust gases of the engine. Such systems, however, by diverting substantially all of the coolant into a heat exchanger, disrupt the coolant flow through the radiator and engine.

SUMMARY OF THE INVENTION

The present invention includes a motor vehicle exhaust gas warm-up system in combination with a motor vehicle having an internal combustion engine with a cooling system using a liquid coolant. The internal combustion engine emits hot exhaust gases through a conventional exhaust system using exhaust pipes and a muffler for conveyance of the hot exhaust gases. The present invention includes a heat exchanger for transferring heat from the hot exhaust gases to the coolant. Suitable conduit conveys a portion of the coolant from the engine to the heat exchanger and back to the engine. A diverter valve diverts the hot exhaust gases from the exhaust system to the heat exchanger and is controlled by a temperature sensing device which senses the temperature of the coolant. The temperature sensing device actuates the diverter valve at a predetermined coolant temperature which diverts the exhaust gases to the heat exchanger to warm the coolant. The diverter valve shuts off the flow of exhaust gas to the heat exchanger when the coolant is sufficiently warm.

The vehicle gas warm-up system diverts the exhaust gas from the exhaust system and consequently does not need an expansion tank. When the coolant is sufficiently warmed, the exhaust gas is allowed to flow back through the exhaust system, stopping further heating of the coolant.

DETAILED DESCRIPTION OF THE PREFERRED EMBODIMENT

Figure 1:
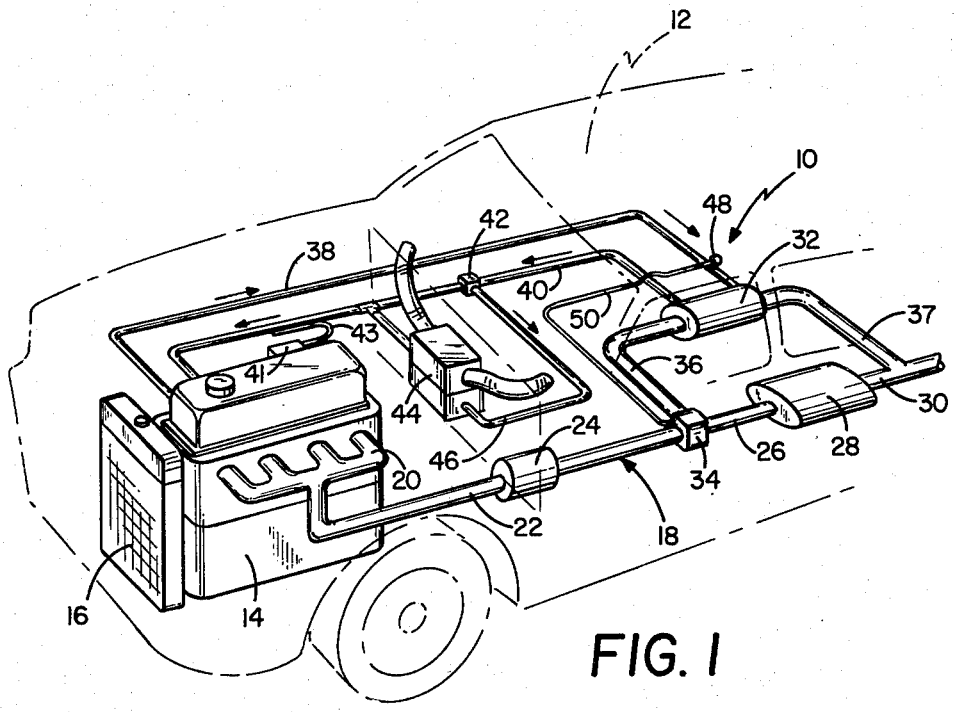
FIG. 1 is a perspective view in diagrammatical form of the system of the present invention illustrating the position of the various elements with respect to a motor vehicle drawn in phantom.
Figure 2:
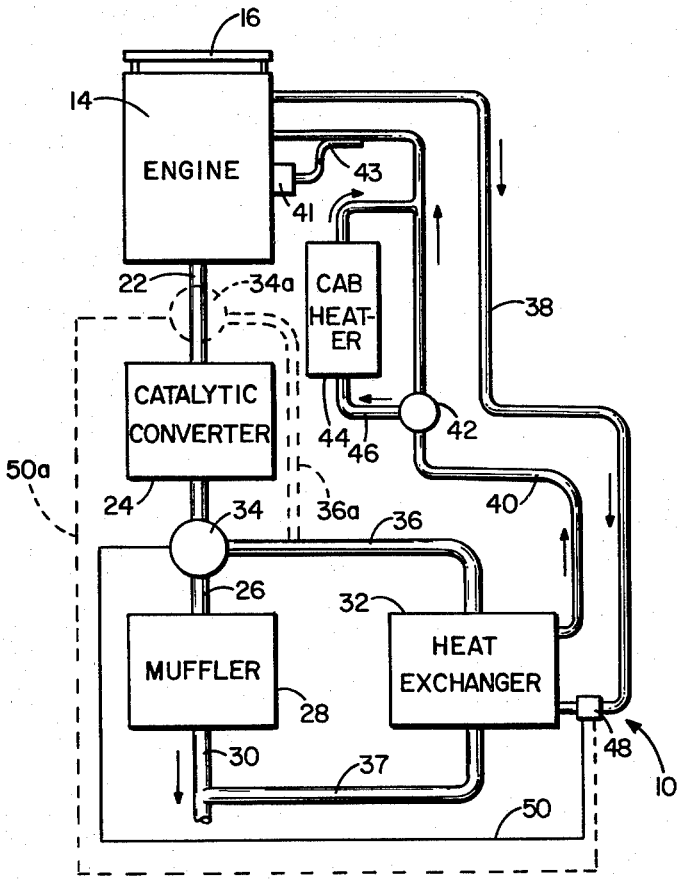
FIG. 2 is a diagrammatical view of the system shown in FIG. 1.

A vehicle exhaust gas warm-up system generally indicated at FIG. 10 is illustrated in FIGS. 1 and 2. The exhaust gas warm-up system is used in a motor vehicle 12, typically an automobile, having an internal combustion engine 14 which is cooled by a cooling system including a radiator 16. The radiator 16 is a conventional radiator providing a reservoir of coolant conveyed by a conventional pump (not shown) into various cavities within the internal combustion engine for the transfer of heat therefrom. Preferably, the coolant is a water based coolant pressurized by the pump.

The internal combustion engine 14 emits hot exhaust gases into an exhaust system 18 which conveys the exhaust gases rearwardly beneath the automobile 12. The exhaust system typically includes an exhaust manifold 20, an exhaust pipe 22, a catalytic converter 24, a connecting exhaust pipe 26, a muffler 28, and a tail pipe 30.

The exhaust gas warm-up system of the present invention includes a heat exchanger 32 which transfers heat from the hot exhaust gases emitted by the engine to the coolant of the cooling system. The heat exchanger 32 is preferably a gas-to-liquid type heat exchanger constructed of a conventional tube or a tube with fins. The preferred heat exchanger design also acts as a muffler for the exhaust gases that pass through.

A diverter valve 34 is preferably located on the connecting exhaust pipe 26 between the catalytic converter 24 and the muffler 28. The diverter valve 34 diverts the exhaust gases passing through the exhaust pipe 26 to the heat exchanger 32 preferably through a by-pass exhaust pipe 36. The diverter valve is suitably constructed to withstand the high temperatures and corrosive environment that is created by the hot exhaust gases. The exhaust gases are preferably diverted back to the exhaust system 18 through a return exhaust pipe 37 to the tail pipe 30.

A portion of the liquid coolant of the cooling system is conveyed to the heat exchanger where heat is transferred to the coolant and the coolant is then conveyed back to the cooling system of the engine 14. More specifically, a portion of the coolant is conveyed to the heat exchanger by a suitable conduit 38. The coolant is transferred back to the engine 14 by return conduit 40. The coolant 14 is transferred through the conduits 38 and 40 by the pressure created by the pump (not shown).

A by-pass valve 42 may be provided to divert the warmed coolant flowing through the return conduit 40 to cab heater 44 through by-pass conduit 46. The cab heater 44 is a conventional cab heater, preferably having a blower blowing air over a plurality of coils through which the warmed coolant passes.

The heated coolant is also used to regulate a choke 41. The choke 41 is a conventional choke with a temperature sensor which regulates the quantity of air being mixed with fuel as a function of temperature. A heat tube 43, to which heat is transferred from the coolant in conduit 40 by suitable means, conveys the heat to the choke 41 thereby closing the choke more quickly and allowing the engine to operate more efficiently.

The diverter valve 34 diverts exhaust gas from the exhaust system to the heat exchanger. A temperature sensing device 48 senses the temperature of the coolant entering the heat exchanger and actuates the diverter valve 34. In some cases, the sensing device 48 may be positioned on a downstream side of the heat exchanger for sensing coolant temperature. The temperature sensing device 48 actuates the diverter valve 34 through transmission lines 50. The transmission lines 50 can be either electrical or pneumatic lines, such as vacuum lines, which send a signal from the temperature sensing device 48 to the diverter valve 34. The diverter valve 34 is normally biased, preferably by a spring, to an open position and is actuated at a predetermined temperature to a closed position. When the coolant temperature is below the predetermined temperature, the diverter valve 34 diverts exhaust gas to the heat exchanger 32. As the coolant is warmed by both the exhaust gases of the heat exchanger and the operation of the engine, the diverter valve 34 is actuated and shuts off the flow of the exhaust gases to the heat exchanger 32. In some cases, the diverter valve may be closed approximately halfway at the predetermined temperature, premitting only a portion of the exhaust gases to be diverted.

The diverter valve 34 may alternatively be positioned before the catalytic converter, as indicated by broken lines 34*a* in FIG. 2. The diverter valve 34*a* is similarly connected to the heat exchanger by by-pass exhaust pipe 36*a* and is actuated by the temperature sensing device 48 through transmission lines 50*a*.

Figure 3:
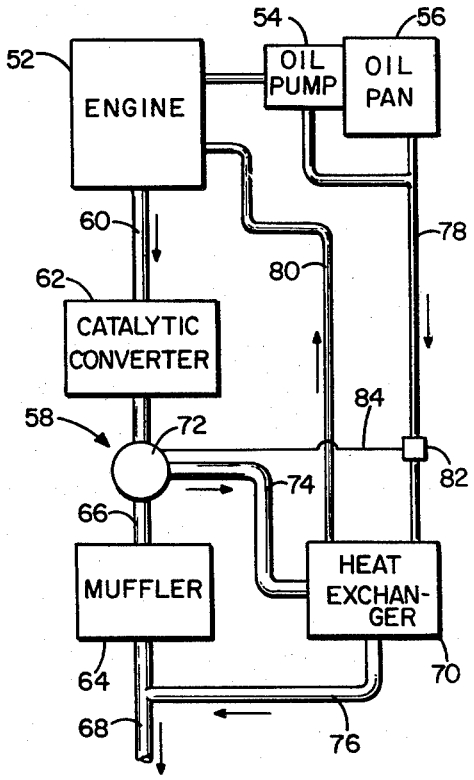
FIG. 3 is a diagrammatical view of another embodiment of the present invention used to heat the crank case oil of an internal combustion engine.

The vehicle exhaust gas warm-up system of the present invention can also be used to prewarm the crank case oil, as shown in FIG. 3. In FIG. 3, an engine 52 has an oil pump 54 that pumps crank case oil from oil pan 56 to the engine. The engine 52 has an exhaust system 58 similar to exhaust system 18. The exhaust system 58 includes an exhaust pipe 60 conveying hot exhaust gases from the engine 52 to a catalytic converter 62, which is connected to a muffler 64 by a connecting exhaust pipe 66. A tail pipe 68 releases the exhaust gases proximate the rear of the car into the environment. A heat exchanger 70 is connected to a diverter valve 72 by a suitable by-pass exhaust pipe 74 conveying the exhaust gases to the heat exchanger. The exhaust gases are then diverted back to the exhaust system into the tail pipe 68 by a return exhaust pipe 76.

A portion of the oil is pumped by oil pump 54 to the heat exchanger 70 through first oil conduit 78 and back to the engine by a second oil conduit 80. A temperature sensing device 82 senses the temperature of the oil entering the heat exchanger and sends a signal through a transmission line 84 to the diverter valve 72. The diverter valve 72 operates in a similar fashion as the diverter valve 34 discussed above and as shown in FIGS. 1 and 2.

As illustrated with regard to the embodiment in FIG. 3, the vehicle exhaust gas warm-up system of the present invention can be used to decrease warm-up time for various engine coolant systems and oil systems not specifically illustrated in the drawings. Other oil systems that can be prewarmed, such as a transmission oil or an axle oil system, are includable within the present invention.

The present invention with the diverter valve controlling the flow of exhaust gases to the heat exchanger eliminates the need for expansion tanks and extra thermostats in providing a warm-up system for the motor vehicle. In addition, since the exhaust gas flow can be shut off to the heat exchanger, overheating of the coolant will not occur.

Using the vehicle exhaust gas warm-up system of the present invention the vehicle interior or cab temperature can be warmed very quickly without having to wait until the engine is warmed. Warming the vehicle interior temperature will prompt the operator of the motor vehicle to drive the vehicle instead of letting it idle for extended periods of time during cold weather, consequently saving fuel normally wasted in warming the interior.

The present invention also raises the temperature of the engine to an efficient operating temperature more quickly. Achieving an efficient operating temperature allows the choke to close sooner, permitting the engine to operate more efficiently. In cold climates, a substantial amount of fuel is wasted in allowing cars to reach an efficient operating engine temperature. In addition, use of electrical engine oil and coolant preheaters is minimized in cold weather saving further energy costs for the vehicle owner.

CONCLUSION

The exhaust gas warm-up system of the present invention is an automatic system that senses engine coolant temperature. If the coolant temperature is low, the exhaust gas is allowed to by-pass the muffler and flow through a heat exchanger where heat is transferred to a portion of coolant diverted to the heat exchanger from the engine. When the engine is sufficiently warm, the flow of exhaust gas is shut off by a diverter valve from the heat exchanger and allowed to flow through the regular exhaust system. Since only a portion of the coolant is diverted, the normal coolant flow through the engine is substantially uninterrupted.

Although the present invention has been described with reference to preferred embodiments, workers skilled in the art will recognize that changes may be made in form and detail without departing from the spirit and scope of the present invention.

What is claimed is:

1. A motor vehicle exhaust gas warm-up system in combination with a motor vehicle, the motor vehicle having an engine with a single cooling system having a liquid coolant for cooling the engine and a conventional exhaust system with a plurality of exhaust pipes and a muffler for conveying hot exhaust gases from the engine, the system comprising:

heat exchanger means for transferring heat from the hot exhaust gases to the coolant;

means for conveying only a portion of the coolant from the engine to the heat exchanger means and back to the engine, the portion being of an amount that substantial interruption of normal coolant flow in the cooling system is avoided;

means for conveying the exhaust gases from the exhaust system to the heat exchanger means;

a diverter valve for diverting the exhaust gases from the exhaust system to the heat exchanger means; and means for sensing the temperature of the coolant and for actuating the diverter valve at a predetermined coolant temperature to control the flow of exhaust gases to the heat exchanger means.

2. The system of claim 1 with an exhaust system having a catalytic converter positioned between the muffler and the engine and wherein the means for conveying the exhaust gases to the heat exchanger means and the diverter valve are positioned downstream from the catalytic converter.

3. The system of claim 1 with an exhaust system having a catalytic converter and wherein the means for conveying the exhaust gases to the heat exchanger means and the diverter valve are positioned upstream of the catalytic converter.

4. The system of claim 1 having an interior heater for heating the driver compartment of the motor vehicle, wherein the means for conveying a portion of the coolant from the heat exchanger means back to the engine conveys the coolant through the interior heater for heating the interior of the motor vehicle.

5. The system of claim 1 and further including means for conveying the exhaust gases from the heat exchanger means back to the exhaust system.

6. The system of claim 1 wherein the means for sensing the temperature of the coolant and for actuating the diverter valve actuates the diverter valve to a substantially closed position substantially shutting off the flow of exhaust gases to the heat exchanger means.

7. The system of claim 1 wherein the engine further includes a choke having a temperature sensing means and wherein the temperature sensing means of the choke senses the coolant temperature being conveyed from the heat exchanger means back to the engine for controlling the choke.

8. The system of claim 1 wherein the means for conveying a portion of the coolant from the engine to the heat exchanger means and back to the engine are a pair of conduit lines.

9. The system of claim 1 wherein the heat exchanger means is a heat exchanger of a tube construction with the hot exhaust gases and the coolant being separated by the walls of the tubes and with the heat being transferred from the hot exhaust gases to the coolant through the walls.

10. The system of claim 1 wherein the cooling system of the motor vehicle has a substantially water based coolant under pressure, the pressure providing the force for conveying the coolant to the heat exchanger means and back to the engine.

11. A motor vehicle exhaust gas warm-up system in combination with a motor vehicle, the motor vehicle having an engine with an oil system for lubrication and a conventional exhaust system with a plurality of exhaust pipes and a muffler for conveying hot exhaust gases from the engine, the system comprising:

heat exchanger means for transferring heat from the hot exhaust gases to the oil;

means for conveying only a portion of the oil to the heat exchanger means and back to a lubrication location, the portion of the oil being of an amount that substantial interruption of oil flow in the oil system is avoided;

means for conveying the exhaust gases from the exhaust system to the heat exchanger means;

a diverter valve for diverting the exhaust gases from the exhaust system to the heat exchanger means; and means for sensing the temperature of the oil and for actuating the diverter valve at a predetermined coolant temperature to control the flow of exhaust gases to the heat exchanger means.

* * * * *